US010610868B2

(12) United States Patent
McCloskey et al.

(10) Patent No.: US 10,610,868 B2
(45) Date of Patent: Apr. 7, 2020

(54) HYDRAULIC CYLINDER SYSTEM FOR ROCK CRUSHERS

(71) Applicant: McCloskey International Limited, Keene (CA)

(72) Inventors: James Paschal McCloskey, Keene (CA); Andrzej Krol, Oshawa (CA); Marian Ando, Peterborough (CA)

(73) Assignee: McCloskey International Limited, Keene, Ontario (CA)

( * ) Notice: Subject to any disclaimer, the term of this patent is extended or adjusted under 35 U.S.C. 154(b) by 1067 days.

(21) Appl. No.: 14/717,651

(22) Filed: May 20, 2015

(65) Prior Publication Data

US 2015/0360228 A1 Dec. 17, 2015

Related U.S. Application Data

(60) Provisional application No. 62/010,959, filed on Jun. 11, 2014.

(51) Int. Cl.
*B02C 2/04* (2006.01)
*B02C 2/02* (2006.01)

(52) U.S. Cl.
CPC ..... *B02C 2/04* (2013.01); *B02C 2/02* (2013.01); *B02C 2/045* (2013.01)

(58) Field of Classification Search
CPC ... B02C 2/04; B02C 2/02; B02C 2/045; F15B 15/149
USPC ..... 241/207, 208, 209, 210, 211, 212, 213, 241/214, 215, 216, 217, 218, 219; 92/86, 92/163
See application file for complete search history.

(56) References Cited

U.S. PATENT DOCUMENTS 1,216,460 A * 2/1917 Kilgore ..... F04B 39/1073 184/28
1,787,700 A * 1/1931 Persons ..... F16J 15/52 417/439
2,268,543 A * 1/1942 Coberly ..... B23P 19/00 29/447
2,272,316 A * 2/1942 Bowen ..... B60T 11/224 60/578
2,399,719 A * 5/1946 Bergh ..... B64C 13/00 220/202
2,589,341 A * 3/1952 Chisholm, Jr. ..... B64C 25/505 180/429
2,593,372 A * 4/1952 Watts ..... B64C 25/60 138/43
2,706,489 A * 4/1955 Pedersen ..... F16K 17/10 137/488

(Continued)

*Primary Examiner* — Shelley M Self
*Assistant Examiner* — Smith Oberto Bapthelus
(74) *Attorney, Agent, or Firm* — Schwabe, Williamson & Wyatt, P.C.

(57) ABSTRACT

A rock crusher is provided that has a crusher cavity defined between a first part and a second part. A plurality of hydraulic cylinders are mounted between the first and second part, the hydraulic cylinders including a relief system. The relief system is included for reducing oil pressure within the hydraulic cylinders in the event uncrushables enter the crusher cavity, the relief system including a relief valve that is designed to open when hydraulic pressure in hydraulic cylinder reaches a predetermined level. This reduces the pressure in the hydraulic cylinder as oil pressure is dumped from the hydraulic cylinder via various oil passages.

10 Claims, 12 Drawing Sheets

(56) References Cited

U.S. PATENT DOCUMENTS 2,756,563 A * 7/1956 Bohlman ..... F15B 15/18 137/625.27
2,791,383 A * 5/1957 Kjelgaard ..... B02C 2/045 241/207
2,799,456 A * 7/1957 Behr ..... B02C 2/06 241/211
3,057,563 A * 10/1962 Behr ..... B02C 2/06 241/211
3,133,707 A * 5/1964 Zimmerman ..... B02C 2/06 241/213
3,604,640 A * 9/1971 Webster ..... B02C 2/045 241/215
3,782,647 A * 1/1974 Decker ..... B02C 2/047 241/215
3,797,760 A * 3/1974 Davis ..... B02C 2/045 241/207
3,887,143 A * 6/1975 Gilbert ..... B02C 2/04 241/215
4,050,359 A * 9/1977 Mayer ..... B63H 20/10 91/422
4,478,373 A * 10/1984 Gieschen ..... B02C 2/045 241/208
4,589,600 A * 5/1986 Schuman ..... B02C 2/04 241/208
4,667,466 A * 5/1987 Mizusaki ..... B60T 11/20 60/574
4,697,745 A * 10/1987 Sawant ..... B02C 2/04 241/207
4,750,681 A * 6/1988 Sawant ..... B02C 2/04 241/208
4,856,716 A * 8/1989 Burstedt ..... B02C 2/047 241/30
5,870,813 A * 2/1999 Ambrose ..... B02C 2/045 29/401.1
5,875,981 A * 3/1999 Ganser, IV ..... B02C 2/045 241/215
5,971,306 A * 10/1999 Ganser, IV ..... B02C 2/045 241/207
7,069,675 B2 * 7/2006 Nishi ..... E02F 9/2267 37/236
8,308,095 B2 * 11/2012 Solomon ..... B02C 2/045 241/207
2004/0035967 A1 * 2/2004 Johnson ..... B02C 2/00 241/207
2005/0269436 A1 * 12/2005 Sawant ..... B02C 2/04 241/215
2009/0152385 A1 * 6/2009 Vendelin ..... B02C 2/045 241/207
2009/0259434 A1 * 10/2009 Loyer ..... B02C 2/06 702/159
2014/0057748 A1 * 2/2014 Satomura ..... F16H 7/1236 474/110
2015/0360228 A1 * 12/2015 McCloskey ..... B02C 2/045 241/32
2018/0297032 A1 * 10/2018 McCloskey ..... B02C 2/04

* cited by examiner

HYDRAULIC CYLINDER SYSTEM FOR ROCK CRUSHERS

CROSS REFERENCE TO RELATED APPLICATIONS

The present application claims priority to U.S. Provisional Patent Application No. 62/010,959, filed Jun. 11, 2014, entitled "Hydraulic Cylinder System for Rock Crushers," the entire disclosure of which is incorporated by reference.

TECHNICAL FIELD

Embodiments herein relate to cone-type rock crushers used to reduce the size of rocks, and more particularly to relief systems used with rock crushers to reduce the likelihood of damage in the event uncrushables pass through the crusher.

BACKGROUND

Rock crushers reduce the size of rocks in order to provide material for road beds, concrete, building foundations and the like. By definition, rock crushers need to be heavy duty to avoid breakage and bending during the crushing process. Rock crushers may be categorized as cone crushers, jaw crushers, and impact crusher, but this disclosure will focus on cone crushers. Cone crushers break up rocks and other hard material by squeezing or compressing it between convex and concave-shaped surfaces covered by hardened wear surfaces. Cone crushers are normally used as the second or third stage crusher, with a reduction ratio of from about 6 to 8 to 1. A typical cone crusher includes a conically-shaped head, which is part of an upper rock crusher assembly. The conical head both gyrates or oscillates and rotates relative to a stationary bowl that includes a hardened bowl liner. The spacing between the bowl liner and the cone at any given point opens and closes as the cone oscillates relative to and inside the bowl. Rocks are deposited in the spacing and the rocks slide down between these surfaces as the space opens, and the rocks are crushed as the space closes.

In this process of rock reduction, it is not uncommon for a large chunk of very hard rock, such as granite or basalt, or a piece of metal, sometimes called tramp iron, such as a tooth from a rock digging bucket, to enter the crusher. If the uncrushable material is larger than the maximum allowed size for passing through the cone crusher, such material can damage the crusher if there is no relief mechanism in place. Rock crushers typically accommodate these uncrushables through a mechanism known as tramp iron relief systems. For example, the bowl in a cone crusher is mounted relative to the cone at a desired fixed spacing. However, the upper assembly, including the bowl, is seated relative to the primary support structure so as to allow lifting of the bowl relative to the cone. The mounting mechanism further typically includes hydraulic clamping cylinders having pistons which serve to resist such lifting of the bowl. The clamping cylinders are pressurized to resistively hold the upper assembly and thus the bowl in place. When the resistance of the clamping cylinders is exceeded, at least one of the cylinder relief valves pops open and the upper assembly, including the bowl, will lift away from the cone and allow passage of the uncrushables. When one or more of the relief valves pops open, hydraulic oil typically flows to an adjacent accumulator. Once the uncrushable passes through the crusher, pressure in the cylinder is reduced, the relief valve reseats, oil flows back to the clamping cylinder from the accumulator, and the crusher is ready to operate. This process is normally very fast, taking no more than a few milliseconds.

The foregoing relief systems work reasonably well to protect cone crushers. However, given that fluid needs to flow from the clamping cylinders to the accumulators before pressure on the crusher is released, the relief might not be as quick as desired. The same is true as oil flows back to the clamping cylinders, and the crusher may not be ready to resume operation as quickly as it might otherwise if hydraulic fluid did not have to flow so far or in such quantity. Also, the accumulators are large, and because they should be positioned close to the cylinders, they may limit the number of clamping cylinders that can be utilized. This requires the bowl and/or the cone to be of heavier construction than might be the case if more cylinders were used or if the relief could be facilitated more quickly. This adds weight and cost to the entire crusher, and makes transporting the crusher more challenging than if it were able to be constructed somewhat lighter.

BRIEF DESCRIPTION OF THE DRAWINGS

Embodiments will be readily understood by the following detailed description in conjunction with the accompanying drawings and the appended claims. Embodiments are illustrated by way of example, and not by way of limitation, in the figures of the accompanying drawings.

DETAILED DESCRIPTION OF DISCLOSED EMBODIMENTS

Figure 1:
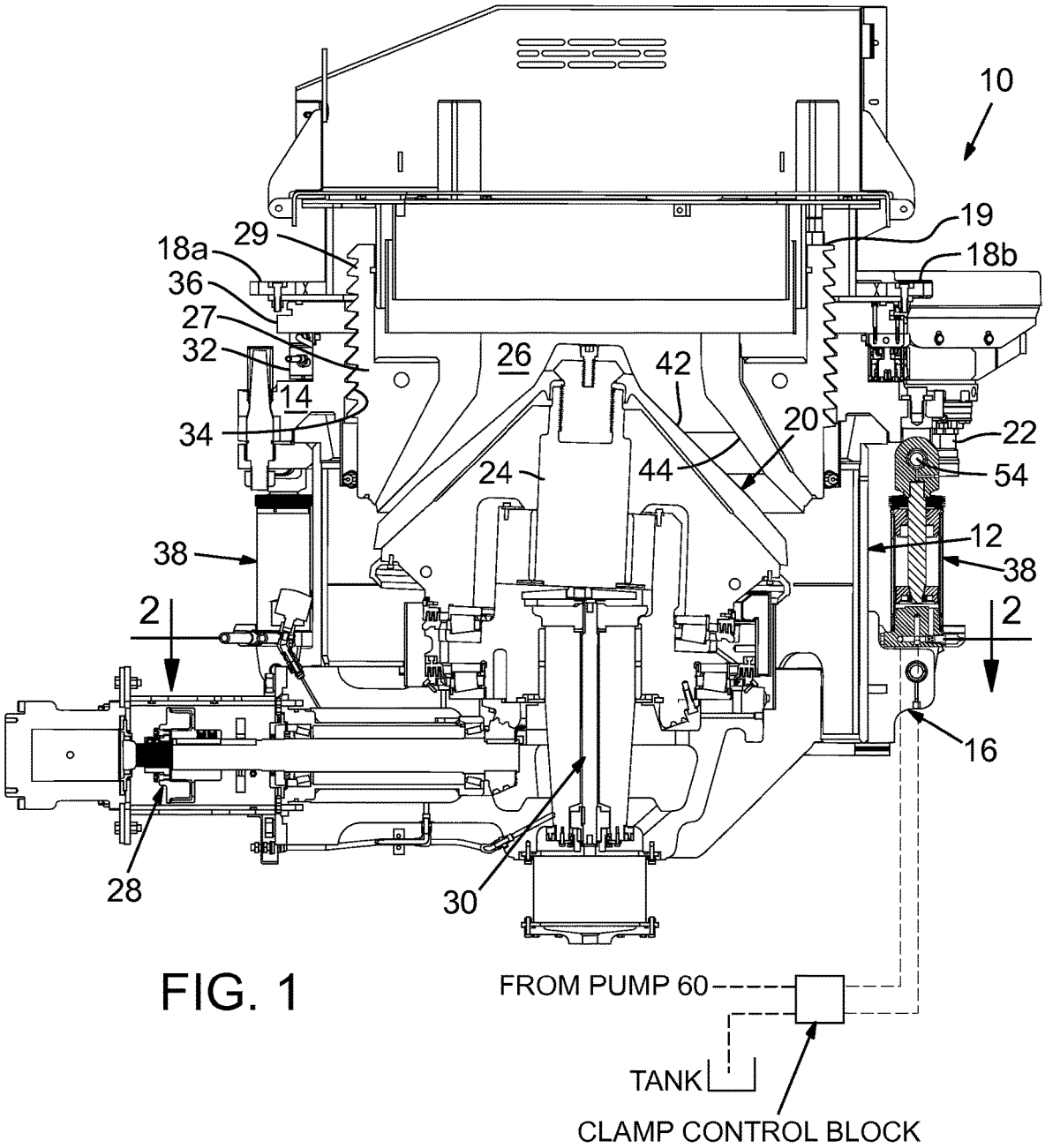
FIG. 1 is a side elevation, sectional view of a cone crusher incorporating the relief system of a first embodiment.
Figure 1A:
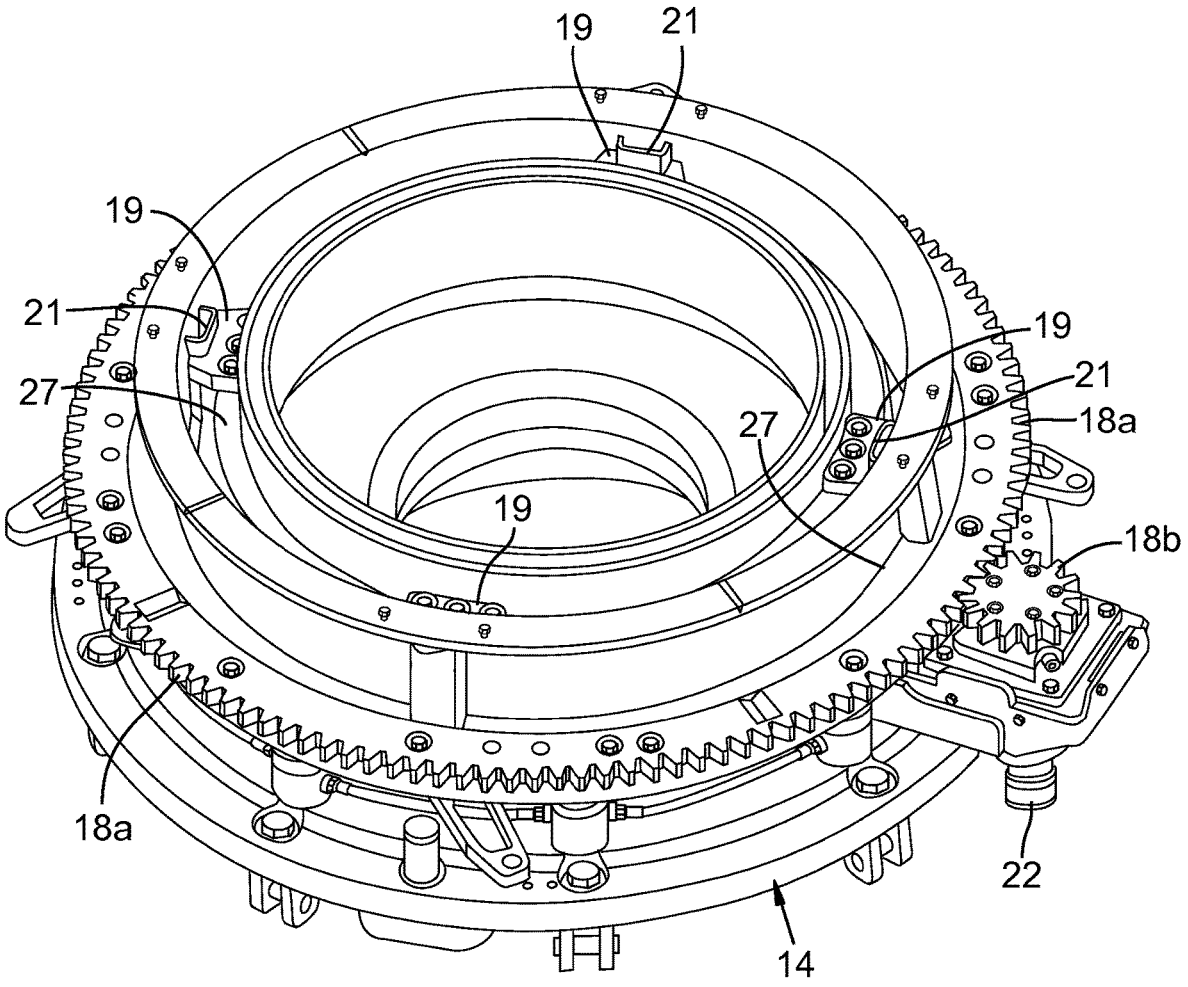
FIG. 1A is a perspective view of the upper part of the cone crusher of FIG. 1.
Figure 1B:
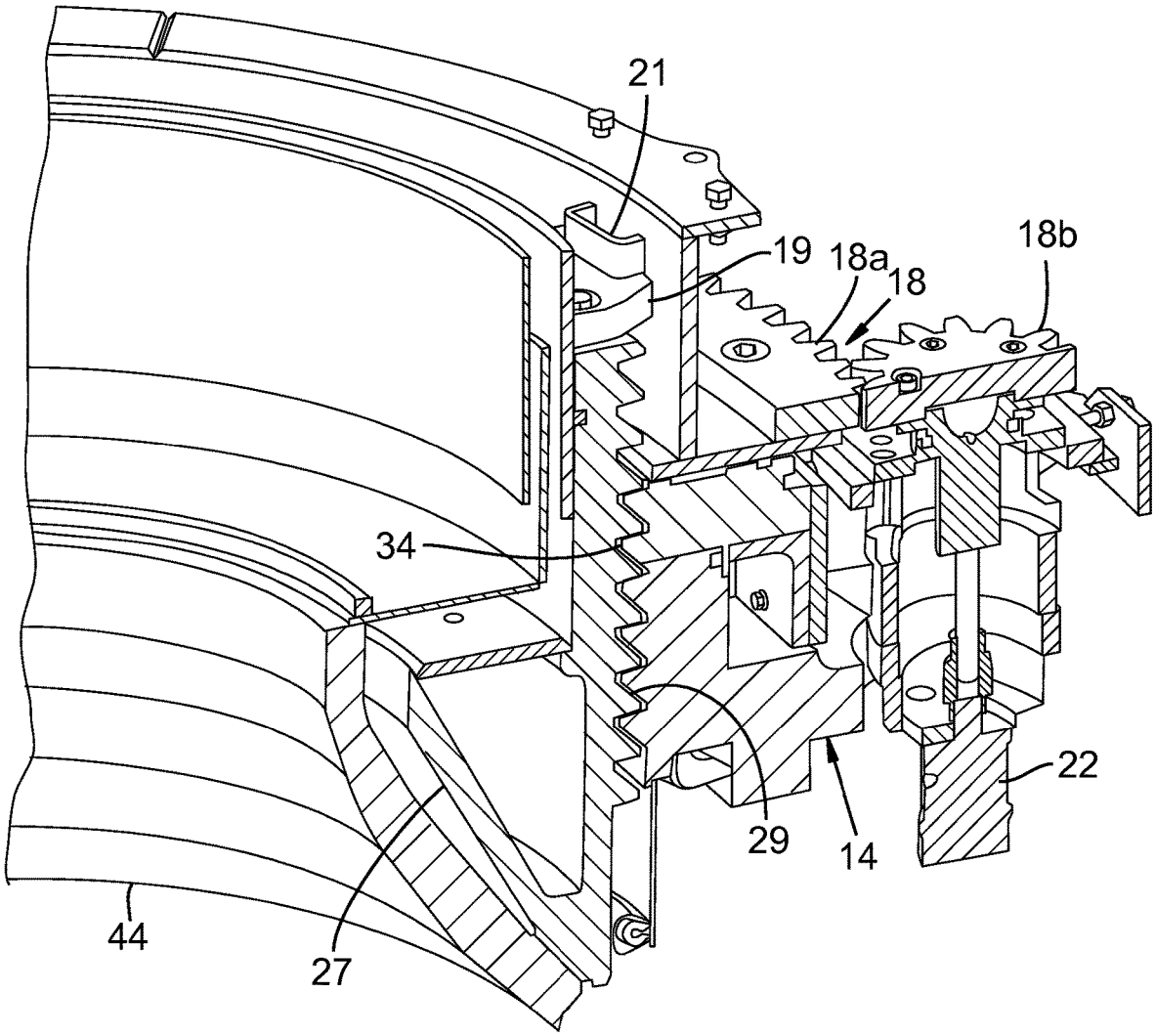
FIG. 1B is a fragmentary, sectional perspective view of a portion of the upper part of the cone crusher depicted in FIGS. 1 and 1A.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense.

Various operations may be described as multiple discrete operations in turn, in a manner that may be helpful in understanding embodiments. However, the order of description should not be construed to imply that these operations are order-dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity. Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

FIG. 1 is a side elevation view of a preferred embodiment of a rock crusher 10. Rock crusher 10 typically includes a mainframe 12 that includes an upper bowl support 14 and a base frame 16. The upper bowl support and base frame may occasionally be referred to herein as a first part and a second part, respectively, or vice versa. Mainframe 12 and upper bowl support 14 normally support an adjustment gear assembly 18, a locking ring 36 and a crusher bowl 27. A crusher cone 20 covered by a mantle 42 is also provided. Adjustment gear assembly 18 typically includes a large adjustment gear **18*a* and a pinion or small adjustment gear 18*b* and an adjustment gear motor 22. Adjustment gear assembly 18 is engaged with crusher bowl 27 by several (here four) sliding tabs 19, each of which includes a pair of ears that surround and slidably engage a vertically extending, substantially C-shaped tab guide 21. This sliding engagement between sliding tabs 19 and tab guides 21 permits adjustment gear assembly 18 to be engaged with crusher bowl 27, even while small adjustment gear 18*b* and adjustment gear motor 22 are rotating to adjust the position of crusher bowl 27 with respect to crusher cone 20**, as will now be explained.

Crusher bowl 27 may include crusher bowl threads 29 on an outer side and a bowl liner 44 on an inner side, facing mantle 42. Upper bowl support threads 34 are mounted to the inner side of upper bowl support 14, threadably mounted to and complementing crusher bowl threads 29. Crusher bowl threads 29 and upper bowl support threads 34 cooperate as crusher bowl 27 is rotatably adjusted by adjustment gear motor 22 and small adjustment gear **18*a* so the complementing crusher bowl threads 29 and upper bowl support threads 34 adjust crusher bowl 27 upwardly or downwardly with respect to crusher cone 20. This causes the gap between bowl liner 44 and mantle 42, commonly called a crusher cavity 26, to be reduced or increased in size as is desirable for handling different sizes of rocks. The dimension of crusher cavity 26** is commonly called the closed size setting gap or CSS gap, and can be precisely set through the arrangement described above.

A plurality (series or set) of hydraulic lock cylinders 32 (here nine, although more or fewer might alternatively be included), are evenly spaced around the periphery of rock crusher 10 to displace locking ring 36 upward to lock adjustment gear assembly 18 once the adjustment gear has positioned crusher bowl 27 appropriately for the types and size of rocks to be crushed. When the position of the crusher bowl 27 needs to be changed to adjust the CSS, hydraulic lock cylinders 32 are released to disengage locking ring 36 from upper bowl support frame 14 and crusher bowl 27, and activate adjustment gear assembly 18, so that adjustment gear motor 22 can be engaged to rotate the crusher bowl and its crusher bowl threads 29 in upper bowl support threads 34. After the CSS is adjusted to its optimal dimension for the rocks being crushed, hydraulic lock cylinders 32 are moved upward to cause locking ring 36 to re-engage with upper bowl support frame 14 and crusher bowl 27. This engagement ensures that the position of crusher bowl 27 will not change during actual crushing operations. The angle between mantle 42 and bowl liner 44 is set as desired to effect maximum crushing while minimizing the likelihood of jamming or damage to the crusher during crushing operations.

A crusher head 24 covered by mantle 42 form crusher cone 20, which during crushing operations is designed to rotate and gyrate to crush rocks as rocks enter crusher cavity 26 and are forced against each other and between mantle 42 and bowl liner 44. A drive assembly 28 provides power to rotate and gyrate crusher head 24 for the crushing operations. Specifically, drive assembly 28 drives a shaft assembly 30 which, in an offset relationship, drives crusher head 24.

Figure 2:
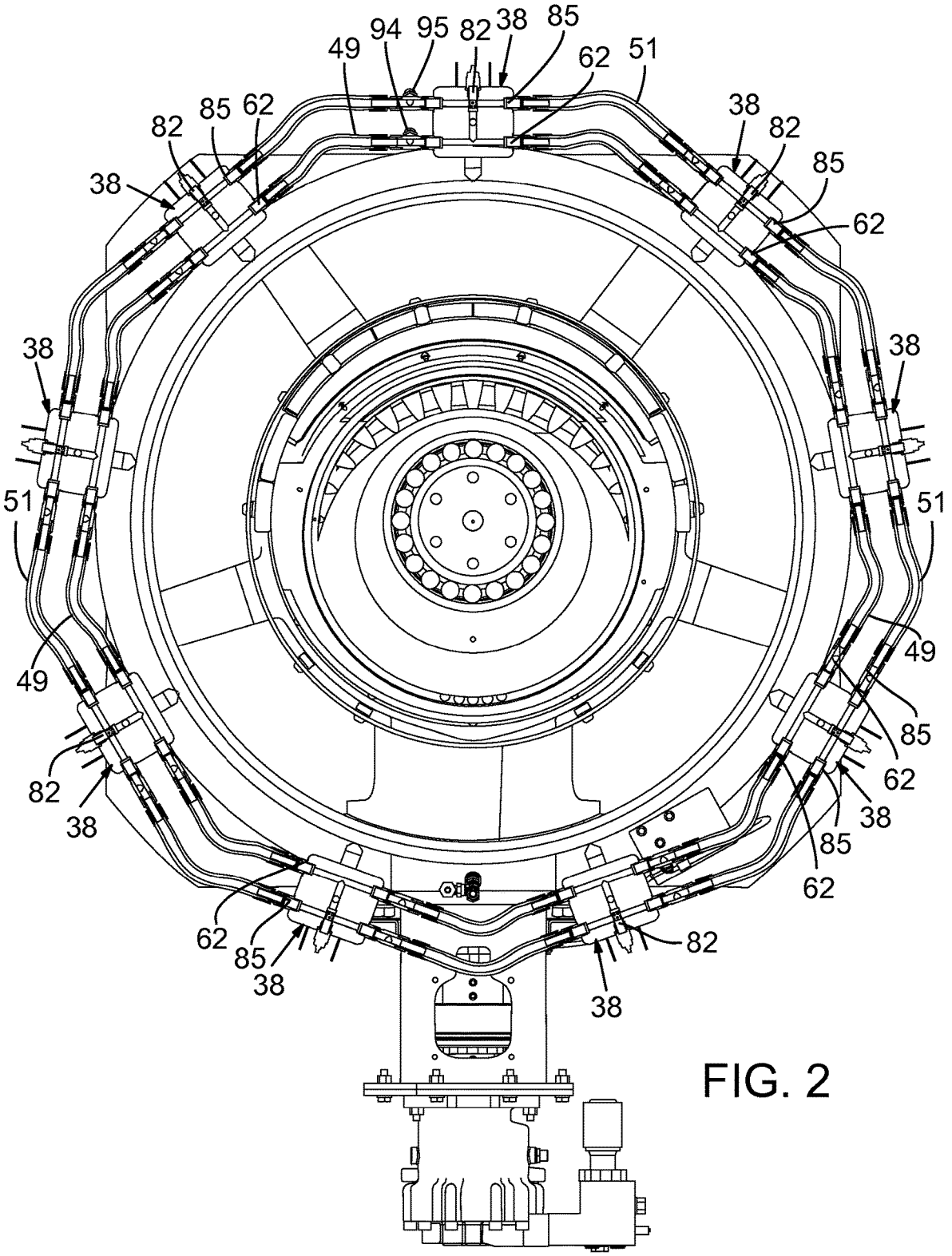
FIG. 2 is a sectional view in plan, taken along line 2-2 of FIG. 1, showing relief cylinders of the first embodiment spaced around the periphery of a cone crusher.

A plurality or series of evenly-spaced, peripherally-positioned clamping cylinders 38 mount upper bowl support 14 to base frame 16 of crusher 10 and provide relief capability to the crusher. This adapts the crusher to handle a large variety of sizes and hardness of materials, and protects the crusher when uncrushables enter crusher cavity 26. Clamping cylinders 38 may include a clamping cylinder upper portion or clevis 46 that is connected to upper bowl support 14 and a clamping cylinder lower portion 48 that is mounted to base frame 16. Clamping cylinders include hydraulic systems that provide shock absorbing capability to the system, and respond to spikes in hydraulic pressure that might otherwise damage the crusher. As shown in FIG. 2, a plurality of clamping cylinders may be provided, evenly spaced around the periphery of rock crusher 10. As with hydraulic lock cylinders 32, nine clamping cylinders are depicted in FIG. 2, but any number of such cylinders may be included, depending upon the desires of the user and the capabilities of the crusher.

One of the advantages of the preferred embodiments are that they may eliminate the necessity of accumulators being positioned between the clamping cylinders, which are commonly required in prior art designs. The elimination of accumulators positioned around the periphery of the crusher often means that more, smaller clamping cylinders can be utilized. The advantage of having more clamping cylinders is that the cylinders will react faster to spikes in pressure and thereby provide greater protection to the crusher components. This means that many of the components, such as upper bowl support 14, can be lighter in weight. It also means that lower hydraulic oil pressure can be used in clamping cylinders 38, which may facilitate a faster response time to pressure spikes caused by uncrushables.

Figure 14:
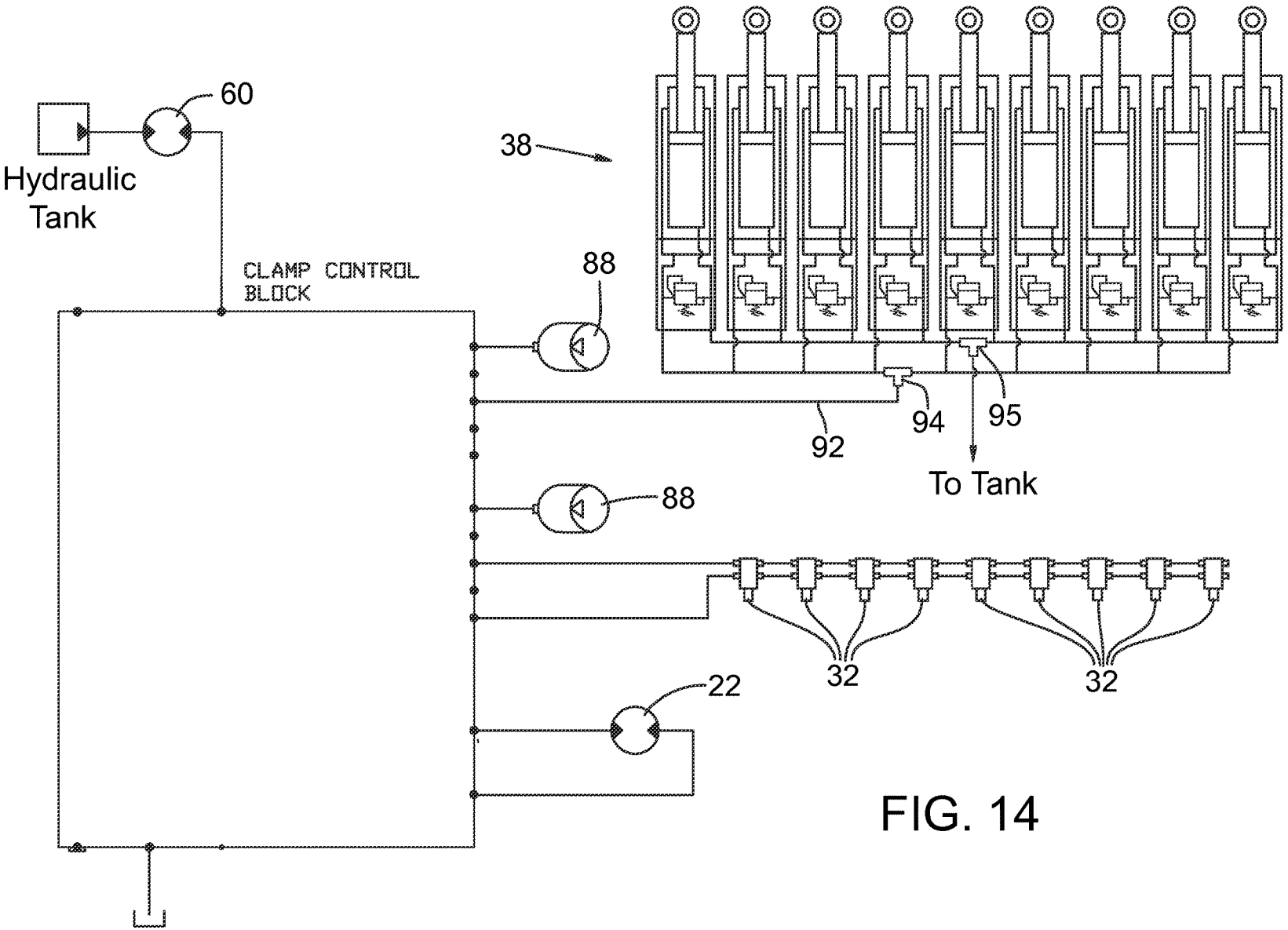
FIG. 14 is a schematic view of the hydraulics of the clamping cylinder system of the first embodiment of the prior figures.

FIG. 2 shows that clamping cylinders 38 may be hydraulically interconnected by hydraulic pressure lines 49 to provide oil under pressure via a pressure-T 94 from a hydraulic pump 60 (FIG. 14). The preferred embodiments are designed such that the system reacts to pressure spikes within each cylinder independently. In the event of a large uncrushable entering the crusher, hydraulic pressure will spike in more than one of the clamping cylinders and the pressure would exceed the pre-set relief pressure so that relief valves 82 in more than one of the (normally adjacent) clamping cylinders would pop open, allowing upper bowl support 14 to lift away from base frame 16 to permit the larger uncrushable to pass. Hydraulic relief lines 51 (FIG. 2) are also provided to facilitate flow from clamping cylinders 38 via a relief-T 95 (also see FIG. 14) when one or more of the relief valves 82 pop open and oil is dumped from any of the cylinders.

Figure 3A:
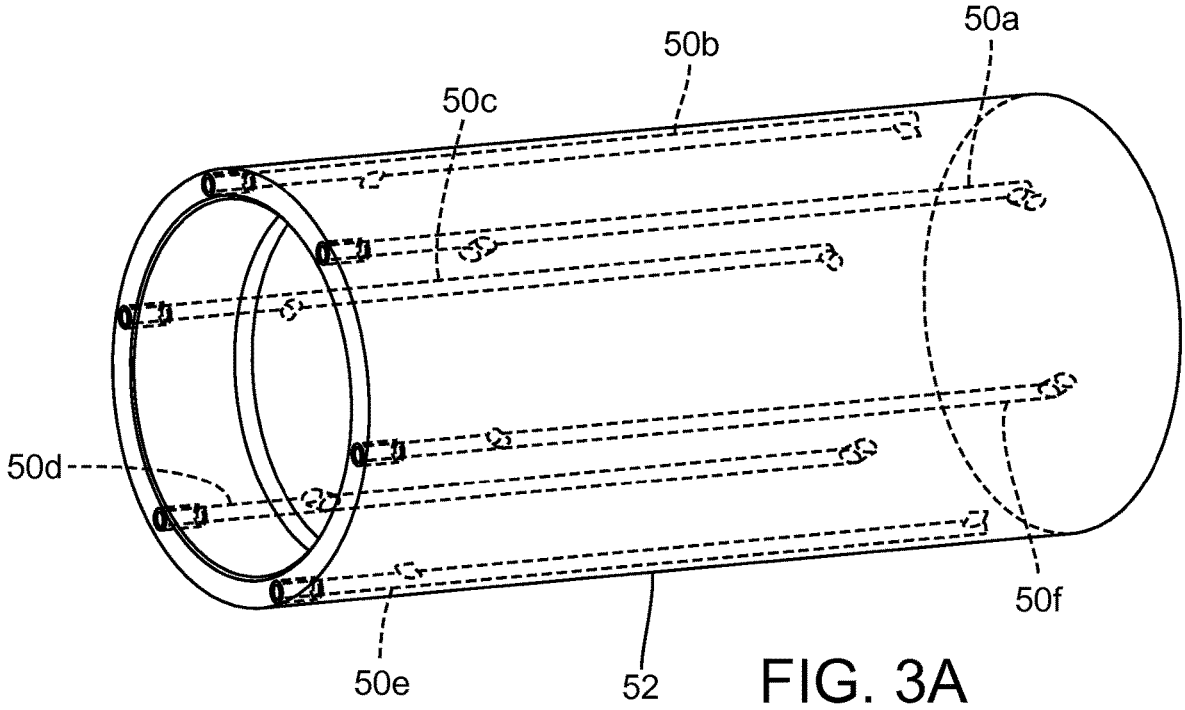
FIGS. 3A and 3B are perspective views of cylinder barrels of the first embodiment with hydraulic oil passages showing in phantom.
Figure 3B:
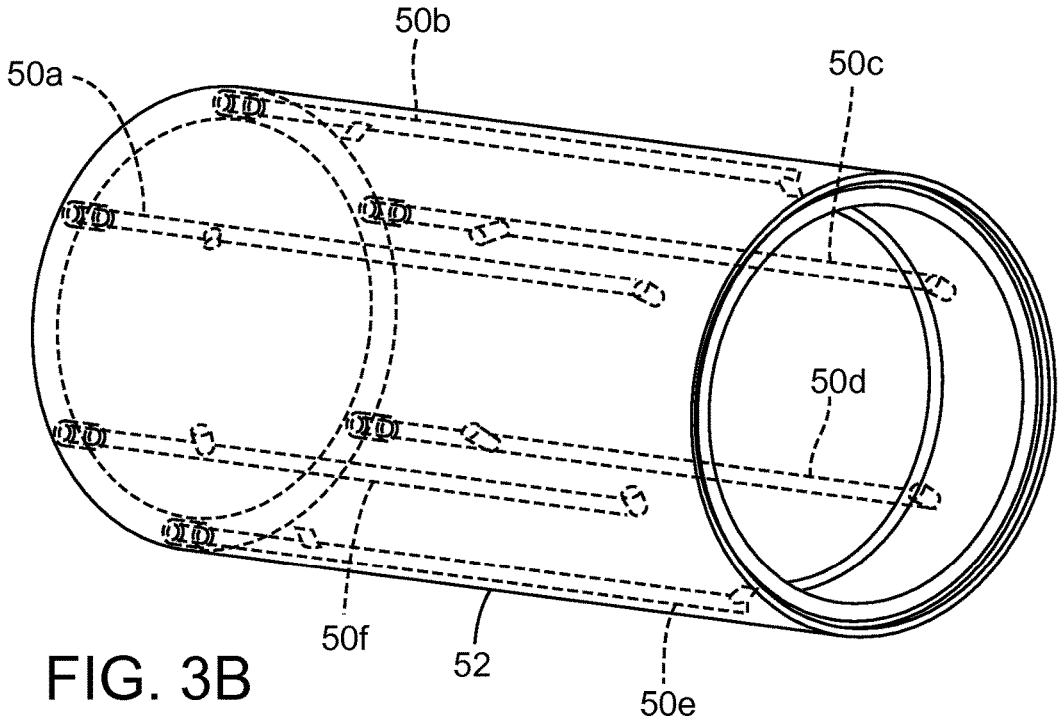

The extremely quick relief that is provided by the preferred embodiment is facilitated by provision of a series of evenly-spaced hydraulic oil passages 50 machined into the barrel 52 of each of the clamping cylinders 38, as shown in FIGS. 3*a* and 3*b*. There may be any number of such passages but in the preferred embodiment there are six passages 50*a*-50*f* drilled into the barrel of each of the clamping cylinders. Passages 50*a*-50*f* extend from one end of each cylinder barrel 52 to most of the way down the length of the barrel. They access the interior of the clamping cylinders via angled conduits, which will be described in detail below. The system for drilling passages 50*a*-50*f* may involve a process in which a spindle drill with linear passages is used, the linear passages being provided for coolant and to remove chips developed in the drilling process. Cylinder barrels 52 may be formed of honed seamless tubing to provide a smooth interior surface.

Figure 4:
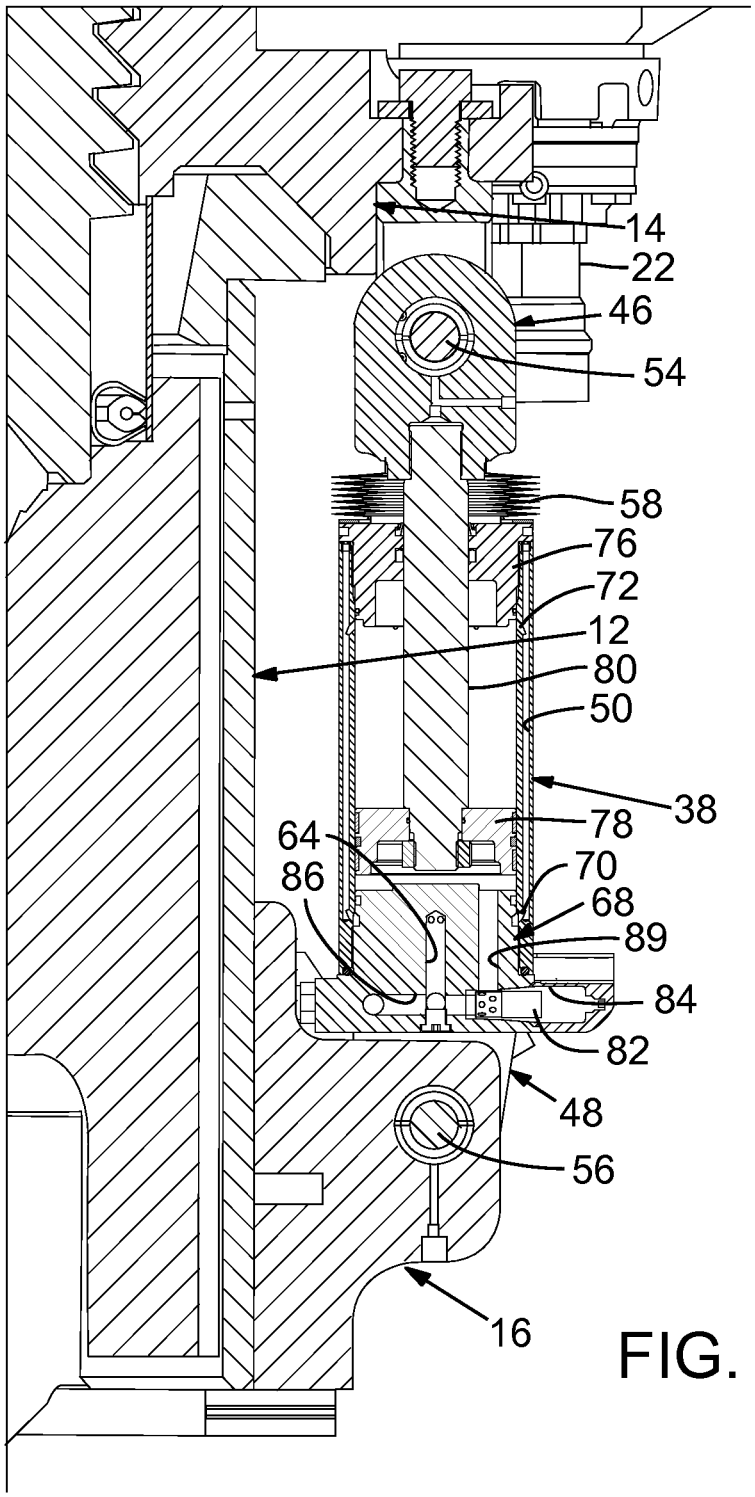
FIG. 4 is an enlarged, side elevation sectional view of one of the two clamping cylinders depicted in FIG. 2, mounted between upper and base frames of the mainframe.
Figure 5:
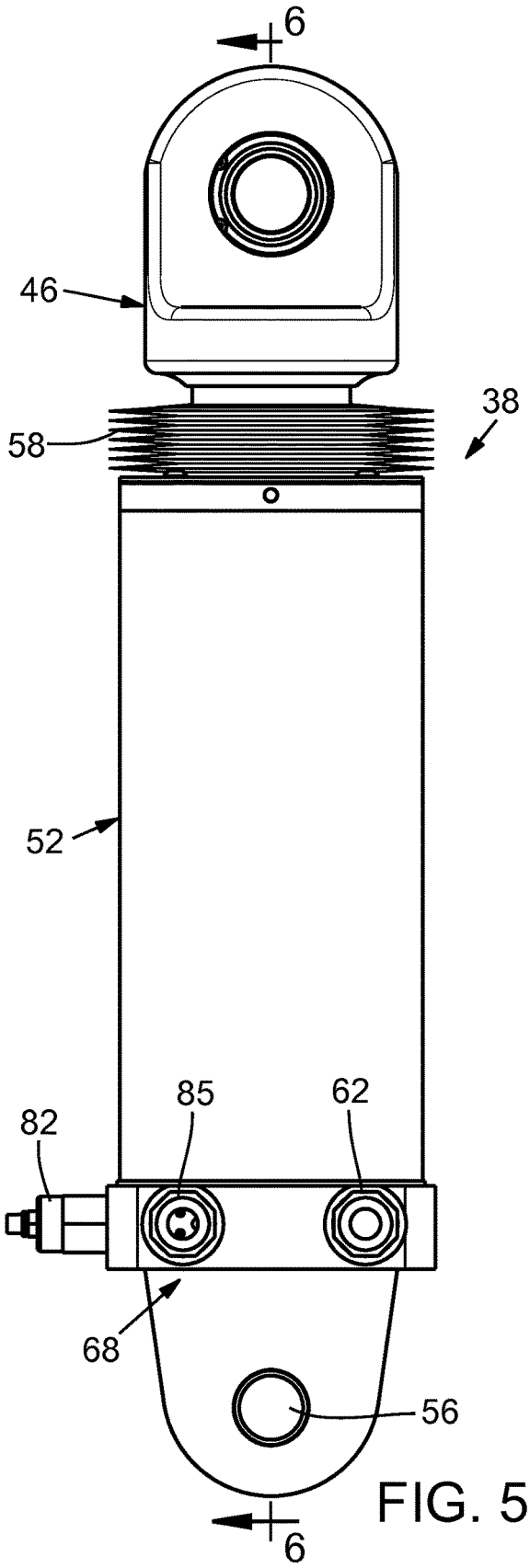
FIG. 5 is a side elevation view of one of the clamping cylinders of the prior figures.

Clamping cylinders 38 are depicted in detail in FIGS. 4-14. FIG. 4 shows one of the clamping cylinders in place in cone crusher 10, mounted between upper bowl support 14 and base frame 16. The mounting may include a top spherical bearing 54 and a bottom spherical bearing 56, which facilitate the upper bowl support and base frame moving in many directions with respect to the clamping cylinders during crushing and crushing relief sequences. The use of spherical bearings may not, however, be necessary in some applications, or may be used in just one of the two bearings. A cylinder rod boot 58 may be included at the top of each clamping cylinder 38 to minimize the likelihood of dust and other crushing debris entering the clamping cylinders.

The hydraulics for controlling the operation of clamping cylinders 38 provide hydraulic fluid under constant pressure from hydraulic pump 60 and the clamp control block, which is of conventional design and which controls the pressure and flow of hydraulic oil under pressure to clamping cylinders 38, (FIG. 14) to each of the cylinders via pressure-T 94, hydraulic pressure lines 49 and hydraulic pressure ports 62 (FIG. 2). As noted earlier, these lines and ports provide hydraulic fluid under pressure to each of the clamping cylinders during crushing operations. That pressure will typically be around 2500 psi.

Figure 6:
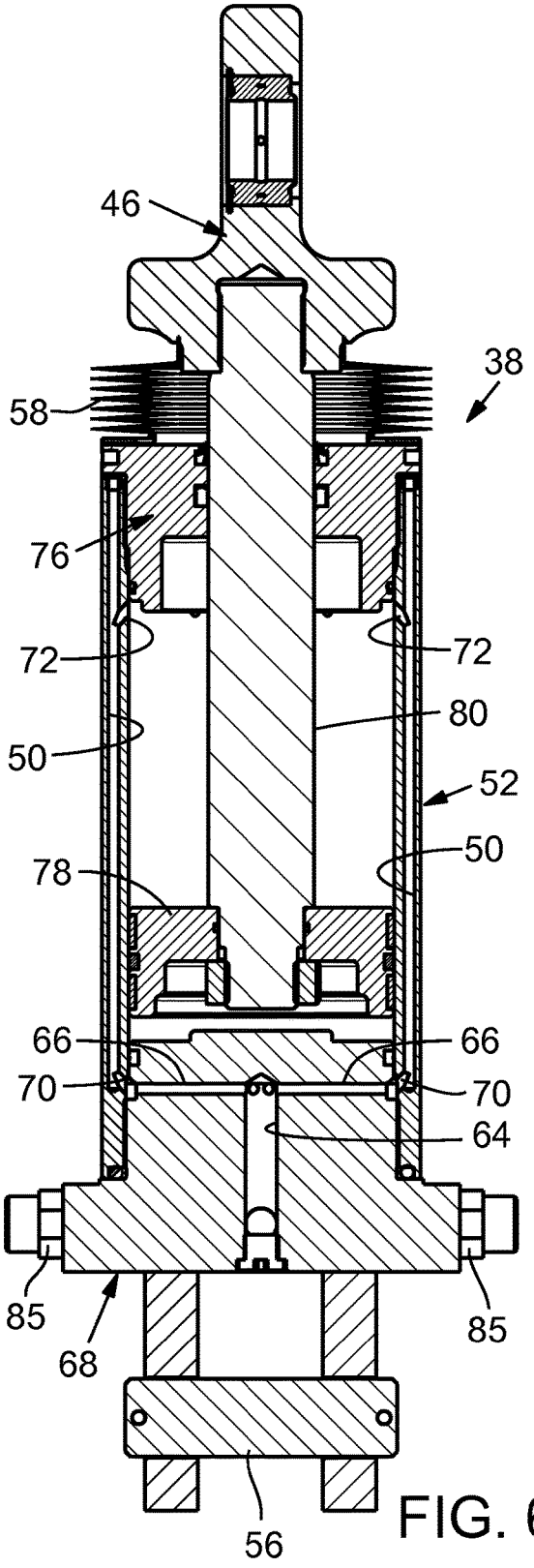
FIG. 6 is a side elevation sectional view of the clamping cylinder of FIG. 5, taken along line 6-6 of FIG. 5.
Figure 7:
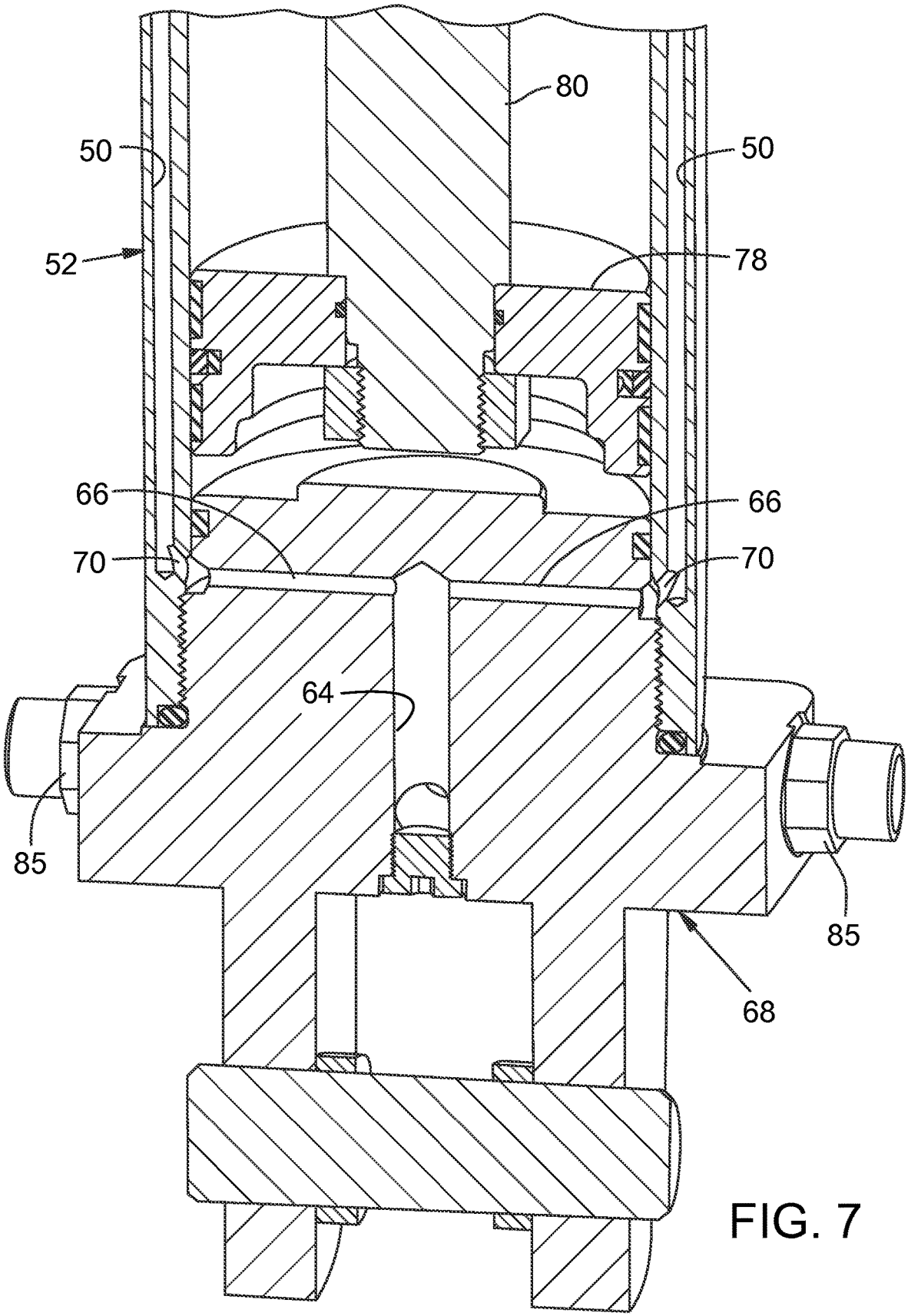
FIG. 7 is a greatly enlarged view of a lower portion of the clamping cylinder corresponding to the section taken in FIG. 6.
Figure 8:
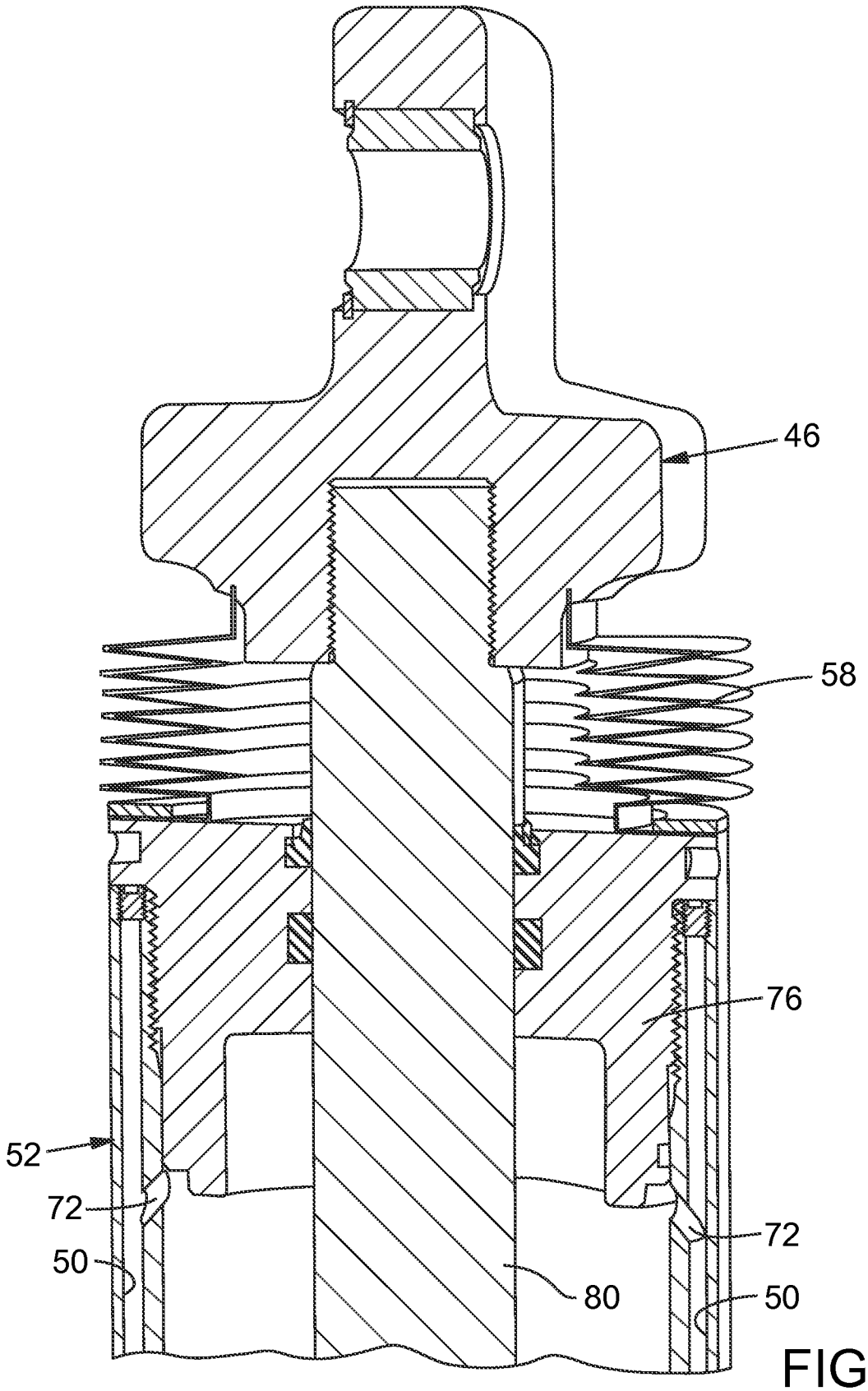
FIG. 8 is a greatly enlarged view of an upper portion of the clamping cylinder corresponding to the section taken in FIG. 6.
Figure 9:
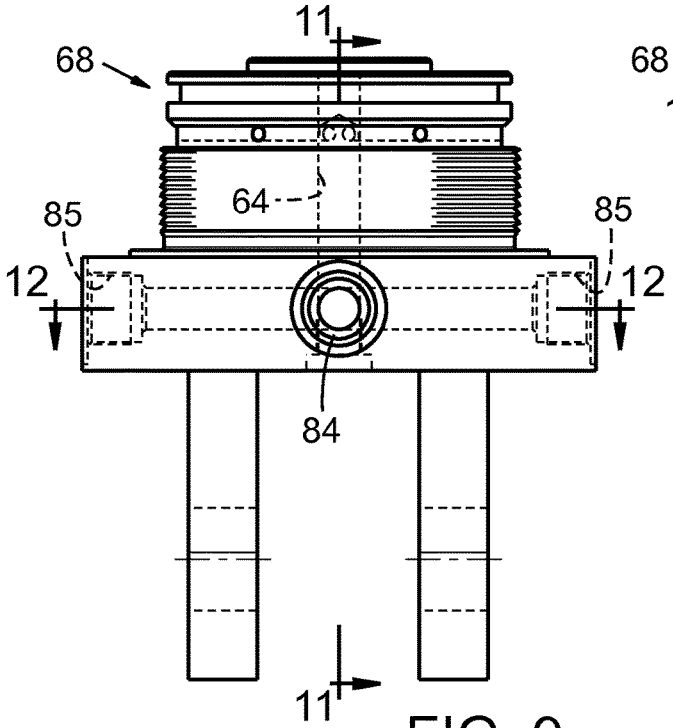
FIG. 9 is a side elevation view of a lower portion of one of the clamping cylinders of the first embodiment, showing some inner channels in phantom.
Figure 10:
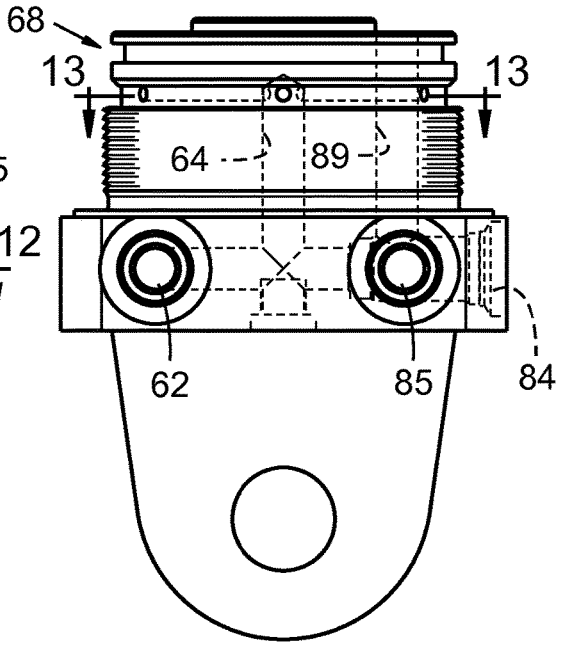
FIG. 10 is a side elevation view of the lower portion of one of the clamping cylinders of the first embodiment, showing some of the inner channels in phantom, taken at 90 degrees from FIG. 9.
Figure 13:
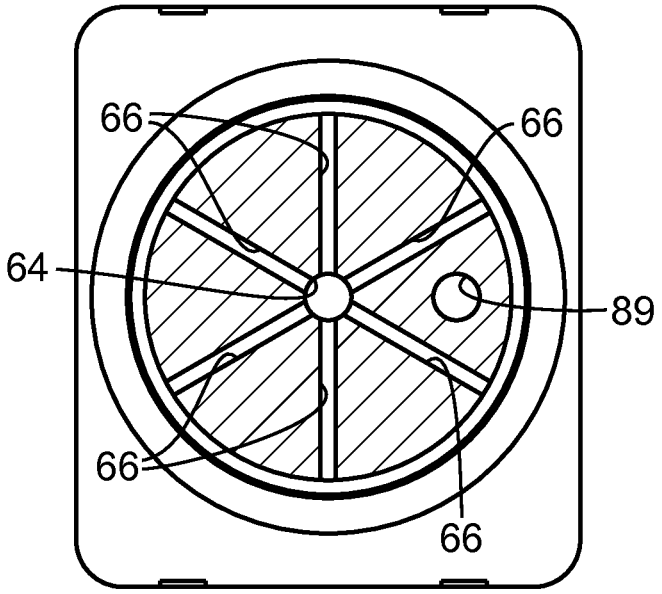
FIG. 13 is an end elevation sectional view taken along line 13-13 of FIG. 10.

The oil under pressure flows from ports 62, through a pressure channel 63 (FIG. 12), into an axial channel 64 and into oil passages 50*a*-50*f* (FIGS. 3A and 3B) via six radial lines 66 in a cylinder base 68 (FIGS. 6, 7 and 13). There may be more or fewer than six radial lines included but that will depend upon the preferences of the manufacturer and the nature of the crushing operations intended for the crusher. In the depicted embodiment oil pressure is then directed through a corresponding number (here six) lower angled conduits 70 (FIG. 7), and up through oil passages 50*a*-50*f* before being directed through a corresponding number of upper angled conduits 72 (FIG. 8) and into clamping cylinder 38. The lower and upper angled conduits 70 and 72, respectively, may be angled at about 45 degrees. Hydraulic pressure is in this manner applied to the underside of a cylinder gland 76 and to the rod end of a piston 78, with a relief channel 87 open to the relief lines 51, thereby holding a piston rod 80 in its lower-most position. This keeps mantle 42 in close proximity to bowl liner 44, facilitating the crushing of rocks entering crusher cavity 26. The hydraulic cylinders can also be mounted upside down (not shown), with piston rod 80 connected to crusher base frame 16 and cylinder base 68 connected to upper bowl support 14.

Figure 11:
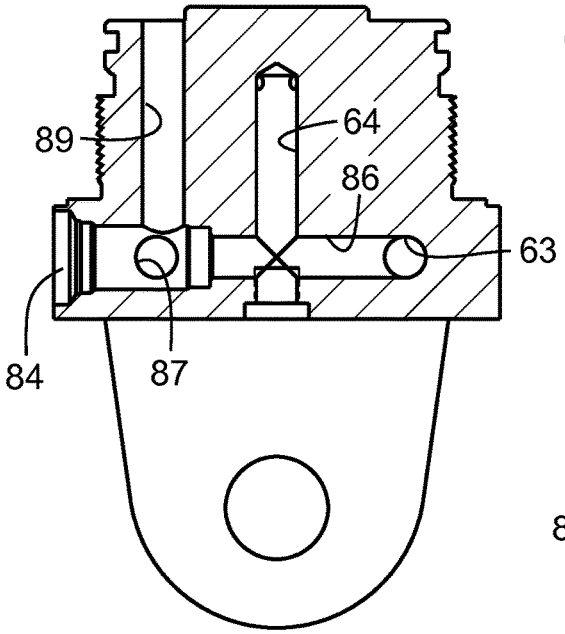
FIG. 11 is a side elevation sectional view of the lower portion of one of the clamping cylinders taken along line 11-11 of FIG. 10.
Figure 12:
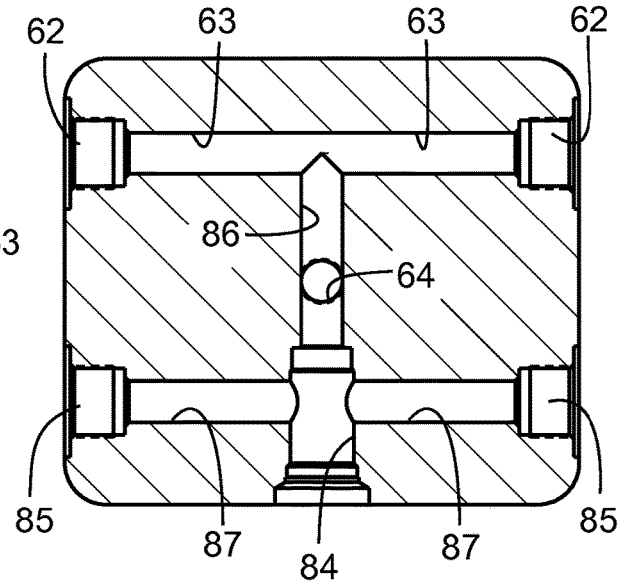
FIG. 12 is an end elevation sectional view taken along line 12-12 of FIG. 9.

FIGS. 10-14 show the hydraulics that facilitate relief in the event uncrushables enter the crusher cavity. Cylinder base 68 includes relief valve 82 (FIG. 5), which may be a Sun RDFA-LAN valve typically set, as mentioned earlier, at about 2500 psi. Relief valve 82 is positioned in a relief valve cavity 84 at a mid-point in relief channel 87 in cylinder base 68 such that the relief valve blocks hydraulic pressure from reaching either of two hydraulic dumping ports 85 or an axially-extending oil return channel 89 (FIGS. 11 and 13). With relief valve 82 in this normal position within relief channel 87, it is adjacent one end of a cross channel 86, blocking the flow of oil from axial channel 64 from reaching relief channel 87, dumping ports 85 and hydraulic relief lines 51. In this normal position, relief valve 82 also blocks flow of pressurized oil from reaching oil return channel 89 and the underside of piston 78, yet leaves the oil return channel open to relief channel 87, dumping ports 85 and relief lines 51.

In operation, when an uncrushable enters crusher cavity 26, the gyration of crusher head 24 will attempt to crush the uncrushable between mantle 42 and bowl liner 44. The uncrushable will prevent mantle 42 from coming as close to bowl liner 44 as it normally would, and this will immediately force the upper end of clamping cylinder 38 upward, causing piston rod 80 to force piston 78 upward, resulting in a spike in oil pressure within clamping cylinder(s) 38. This oil relieved from the pressure spike will immediately be transmitted through oil passages 50*a*-50*f*, lower angled conduits 70, radial lines 66, axial channel 64, cross channel 86 to relief valve 82. Relief valve 82 will be set to sense an increase in pressure, for example greater than 2500 psi, causing the relief valve to be forced open.

The opening of relief valve 82 opens up the flow of hydraulic oil from cross channel 86 into relief channel 87, dumping oil through hydraulic dumping ports 85 and hydraulic relief lines 51, and simultaneously opening oil return channel 89, which sends pressure to the underside of piston 78. This drop in oil pressure in axial channel 64 will be immediately passed up oil passages 50*a*-50*f*, relieving pressure in clamping cylinder 38, and, in combination with the pressure sent to the underside of piston 78 by oil return channel 89, causing the piston to move up, thus permitting upper portion 46 of clamping cylinder 38 and upper bowl support 14 to move upward. This will increase the spacing between mantle 42 and bowl liner 44, allowing the uncrushable to pass through crusher 10.

Once the increased pressure is reduced, such as after the uncrushable passes through the crusher, this decrease in pressure will be immediately transmitted through the system to relief valve 82, permitting it to return to its original position, blocking the flow of hydraulic oil between axial channel 64 and relief channel 87, while permitting oil pressure to pass from the underside of piston 78 through oil return channel 89 and out the two ends of relief channel 87, dumping ports 85 and into hydraulic relief lines 51.

The fact that a plurality of evenly-spaced hydraulic oil passages 50*a*-50*f* pass directly through cylinder barrels 52 in small, spaced passages, without having to be directed through external conduits and dump to external accumulators, dramatically increases the speed at which pressure increases and decreases can be sensed by relief valve 82. Because the oil passages may be small, and the route the pressure is directed is so much shorter than in conventional crushers, there is less danger of damage to the crusher as it tries to crush uncrushables, and the components can be lighter weight and therefore less costly. The fact that the use of oil passages 50*a*-50*f* may eliminate the need for bulky accumulators positioned between clamping cylinders 38 makes it possible to include almost twice as many, smaller clamping cylinders that can operate at lower pressures, further speeding the relief process in the event of uncrushables.

The ability to operate the clamping cylinders at lower pressures means that the cylinder barrels 52 can be thinner, reducing the weight of each cylinder, again permitting the entire crusher to be of lighter construction. The fact that there are typically many (here six) such oil passages 50*a*-50*f*, evenly positioned around the circumference of the cylinder, means that oil pressure that is applied to or drawn from clamping cylinder 38 will be easier on the piston rings and bearing seals than a system in which pressure is applied to and drawn from only one or two ports. This means that the rings and seals will last longer, thereby potentially reducing maintenance costs and down time when compared to conventional crushers.

By providing more, smaller clamping cylinders 38, cone crusher 10 provides greater flexibility in relieving pressure spikes due to uncrushables entering crusher cone 20. Thus, if a small uncrushable enters the system, this may cause pressure spikes in only one or two of the clamping cylinders. However, if a larger uncrushable is present, several of the cylinders might be affected, allowing upper bowl support 14 of mainframe 12 to lift well away from base frame 16, opening up the space between mantle 42 and bowl liner 44. The use of many smaller clamping cylinders may also decrease the time of the displacement, which may often be as short as 2-3 milliseconds.

FIG. 14 is a schematic drawing of the hydraulics used for clamping cylinders 38. Previously noted is the fact that accumulators, which are typically positioned between adjacent clamping cylinders around a cone crusher, may be eliminated through the use of the preferred embodiment. However, as shown in FIG. 14, it is normally necessary to include one or two system accumulators 88. The other components depicted in FIG. 14 will be clear to one with skill in the art.

Some non-limiting examples are below:

Example 1 provides a rock crusher having a crusher cavity defined between a first part and a second part, and may include a plurality of hydraulic cylinders mounted between the first and second parts, each of the hydraulic cylinders formed of cylinder barrels and including a base and a plurality of oil passages longitudinally extending and evenly spaced around and within the cylinder barrels, each of the oil passages including a first port accessing the interior of the hydraulic cylinder at a point remote from the cylinder base, and a second port disposed adjacent the cylinder base;

a hydraulic pump providing oil pressure to the hydraulic cylinders; and a relief system for reducing oil pressure within the hydraulic cylinders in the event uncrushables enter the crusher cavity, the relief system including a relief valve disposed adjacent the cylinder base and in hydraulic communication with the second ports, the relief valve designed to open when hydraulic pressure in the hydraulic cylinder reaches a predetermined level, thereby reducing pressure in the hydraulic cylinder as oil pressure is dumped from the hydraulic cylinder via the oil passages.

Example 2 includes the rock crusher of example 1, wherein the rock crusher is a cone crusher, the first part is a crusher bowl, and the second part is a cone.

Example 3 also includes the rock crusher of example 1 wherein the oil passages include extended portions between the ports that extend a substantial length of the cylinder, parallel to a longitudinal axis of the cylinder wall in which they are disposed.

Example 4 also includes the rock crusher of example 1, wherein the relief valve moves between an open position and a closed position, and a piston disposed in each of the hydraulic cylinders, the piston being connected to the first part such that when the relief valve opens and pressure in the hydraulic cylinder is reduced, the piston is displaced in a direction toward the first part, and when the relief valve closes, the piston is displaced in a direction away from the first part.

Example 5 includes the rock crusher of example 5 wherein the first part is an upper bowl support of a cone crusher.

Example 6 provides a relief system for a rock crusher including a first part and a second part that are mounted to move with respect to each other to crush rocks disposed therebetween, a plurality of hydraulic clamping cylinders, each of the cylinders including a cylinder wall with a piston mounted therein, the piston being connected to the first part, and a plurality of relief valves, one of which is mounted in hydraulic communication with each of the cylinders, wherein the relief system includes a plurality of spaced oil passages disposed within each of the cylinder barrels and extending a substantial length of each of the cylinders, each of the oil passages including a first port for accessing hydraulic pressure in the cylinder and a second port for conveying that pressure to one of the relief valves, such that oil pressure can be conveyed to and from the hydraulic cylinders via the oil passages, depending on whether pressure in the crusher cavity is increasing or decreasing, and such that when hydraulic pressure is reduced in a cylinder, the piston in that cylinder permits the first part to move away from the second part.

Example 7 provides a cone crusher having a crusher cavity defined between a bowl mounted to an upper bowl support of the crusher and a cone mounted to a base frame of the crusher, between which rock is crushed, comprising a plurality of hydraulic cylinders mounted between the upper and base frames and evenly disposed around the crusher, the hydraulic cylinders formed of cylinder barrels and including a relief system for permitting the bowl to move away from the cone in the event uncrushables enter the crusher cavity, the relief system including a plurality of oil passages longitudinally extending and evenly spaced around and within the cylinder barrels, the oil passages each having a first port for accessing oil pressure within the hydraulic cylinder and a second port for conveying that pressure to a relief valve, such that when the pressure within the hydraulic cylinder reaches a predetermined level, the relief valve opens, relieving the oil pressure in the hydraulic cylinders via the oil passages such that oil pressure can be conveyed to and from the oil passages depending on whether pressure in the crusher cavity is increasing or decreasing.

Example 8 includes the cone crusher of example 7, further including a hydraulic pump that provides pressure to the hydraulic cylinders and wherein the hydraulic cylinders each includes a piston and piston rod, the piston rod connected to the upper bowl support such that when hydraulic pressure is reduced within one of the cylinders, the piston in that cylinder is permitted to move toward the upper bowl support, permitting the bowl to move away from the cone and let the uncrushable pass, after which the pressure in the cylinder is reduced and the reduction in pressure is conveyed via the oil passages to the relief valve, which closes to permit the hydraulic pump to increase the pressure in the hydraulic cylinders.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A cone crusher having a crusher cavity defined between a crusher bowl and a crusher cone, comprising:

a plurality of hydraulic cylinders mounted between the crusher bowl and crusher cone, each of the hydraulic cylinders has an inner and outer cylinder barrel walls, and including a base and a plurality of oil passages longitudinally extending and evenly spaced around and in the cylinder barrel between the cylinder barrel walls, each of the oil passages including a first port accessing the interior of the hydraulic cylinder at a point remote from the cylinder base, and a second port disposed adjacent the cylinder base;

a hydraulic pump providing oil pressure to the hydraulic cylinders; and a relief system for reducing oil pressure within the hydraulic cylinders in the event uncrushables enter the crusher cavity, the relief system including a relief valve disposed adjacent each cylinder base and in hydraulic communication with the second ports in each cylinder, the relief valve designed to open when hydraulic pressure in one or more selected cylinders reaches a predetermined level, thereby reducing pressure in the one or more hydraulic cylinders as oil pressure is dumped from the one or more hydraulic cylinders via the oil passages, wherein the relief valve moves between open and closed positions, and a piston is disposed in each of the hydraulic cylinders, the piston being connected to the crusher bowl such that when the relief valve opens and pressure in the one or more hydraulic cylinders is reduced, the piston in the one or more cylinders is displaced in a direction toward the crusher bowl, and when the relief valve closes, the piston is displaced in a direction away from the crusher bowl.

2. The cone crusher of claim 1 wherein the oil passages include portions between the ports that extend a substantial length of the cylinder, parallel to a longitudinal axis of the cylinder barrel in which they are disposed.

3. The crusher of claim 1, further comprising the piston sealing off an interior area of each of the cylinders to block flow through or around the piston.

4. A relief system for a rock crusher including a first part and a second part that are mounted to move with respect to each other to crush rocks disposed therebetween, a plurality of hydraulic clamping cylinders, each of which has an inner and outer cylinder barrel walls, with a piston mounted in the cylinder barrel to prevent hydraulic pressure from flowing past the piston, the piston being connected to the first part, and a plurality of relief valves, one of which is mounted in hydraulic communication with each of the cylinders, wherein the relief system comprises:

a plurality of spaced oil passages disposed in each of the cylinder barrels between the inner and outer cylinder walls and extending a substantial length of each of the cylinders, each of the oil passages including a first port for accessing hydraulic pressure in the cylinder and a second port for conveying that pressure to the relief valve, such that oil pressure can be conveyed to and from the cylinders via the oil passages, depending on whether pressure in the cylinders is increasing or decreasing, and such that when hydraulic pressure is reduced in a cylinder, the piston in that cylinder permits the first part to move away from the second part.

5. The relief system of claim 4, wherein the piston extends within the inner cylinder barrel wall to prevent hydraulic pressure from flowing past the piston.

6. The relief system of claim 4 wherein at least one of the ports facilitates the exertion of hydraulic pressure on an underside of the piston to limit downward movement of the piston.

7. The relief system of claim 4 wherein the first and second ports are generally radially-extending for facilitating the transmission of hydraulic pressure from between the cylinder walls to the interior of the cylinder.

8. A cone crusher having a crusher cavity defined between a bowl mounted to an upper bowl support of the crusher and a cone mounted to a base frame of the crusher, between which rock is crushed, comprising:

a plurality of hydraulic cylinders mounted between the upper bowl support and the base frame and evenly disposed around the crusher, the cylinders formed of cylinder barrels and including a relief system for permitting the bowl to move away from the cone in the event uncrushables enter the crusher cavity, the relief system including:

a relief valve disposed adjacent each of the cylinders; and a plurality of oil passages longitudinally extending in each of the cylinder barrels, the oil passages each having a first port for accessing oil pressure within the adjacent cylinder and a second port for conveying that pressure to the adjacent relief valve, such that when the pressure within the adjacent cylinder reaches a predetermined level, the adjacent relief valve opens, relieving the oil pressure in the adjacent cylinder via the oil passages, such at that oil pressure can be conveyed to and from the oil passages depending on whether pressure in the adjacent cylinder is increasing or decreasing.

9. The cone crusher of claim 8, further comprising a hydraulic pump that provides pressure to the hydraulic cylinders and wherein each of the hydraulic cylinders includes a piston and piston rod, the piston rod connected to the upper bowl support such that when hydraulic pressure is reduced within one of the cylinders, the piston in that cylinder is permitted to move toward the upper bowl support, permitting the bowl to move away from the cone and let the uncrushable pass, after which the pressure in that cylinder is reduced and the reduction in pressure is conveyed via the oil passages to the relief valve, which closes to permit the hydraulic pump to increase the pressure in that cylinder.

10. The crusher of claim 8 wherein the piston is designed to be impervious to fluid flow therethrough so that the position of the piston is controlled by hydraulic pressure within the cylinder.

* * * * *